US005406901A

United States Patent [19]

Ellis

[11] Patent Number: 5,406,901

[45] Date of Patent: Apr. 18, 1995

[54] OPEN CELLULAR CONTAINERSHIP

[75] Inventor: Wilfred Ellis, Toronto, Wales

[73] Assignee: Advance Ship Design Pty Ltd., North Sydney, Australia

[21] Appl. No.: 839,553

[22] Filed: Feb. 24, 1992

Related U.S. Application Data

[63] Continuation-in-part of Ser. No. 352,709, May 11, 1989, Pat. No. 5,090,353, which is a continuation of Ser. No. 44,276, Apr. 27, 1987, abandoned.

[51] Int. Cl.[6] ..... B63B 25/00

[52] U.S. Cl. ..... 114/72

[58] Field of Search ..... 114/72, 75, 74 A, 26, 114/84, 85, 183 R, 184, 259, 260, 65 R

[56] References Cited

U.S. PATENT DOCUMENTS

| | | | |
|---|---|---|---|
| 1,806,725 | 5/1931 | Walton | 114/183 R |
| 2,963,310 | 2/1960 | Abolins | 294/68.3 |
| 3,537,414 | 11/1970 | Goldman | 410/89 |
| 3,583,350 | 6/1971 | Goldman | 114/72 |
| 3,807,582 | 4/1974 | Anderson | 414/141.3 |
| 3,836,026 | 9/1974 | Peterson | 414/786 |
| 4,043,285 | 8/1977 | Nordstrom | 114/72 |
| 4,082,051 | 4/1978 | Timmann et al. | 114/72 |
| 4,850,294 | 7/1989 | Caillet | 114/201 R |

FOREIGN PATENT DOCUMENTS

| | | |
|---|---|---|
| 1816487 | 7/1970 | Germany . |
| 1951569 | 7/1970 | Germany . |
| 2826742 | 12/1974 | Germany . |
| 3034871 | 4/1982 | Germany . |
| 3304069 | 8/1984 | Germany . |

*Primary Examiner*—Edwin L. Swinehart
*Attorney, Agent, or Firm*—Richard C. Litman

[57] ABSTRACT

An open cellular containership includes a hull having side walls and load bearing decks with transverse bulkheads defining a plurality of cargo holds therein each provided with elements defining adjacent cells with each hold adapted to receive a plurality of tiers of ISO shipping containers. The plurality of tiers of containers are stacked within the hold cells until the top surface of the uppermost containers are disposed adjacent the strength decks atop the side walls, without any hatch covers being mounted thereatop. This hatchcoverless containership construction is possible due to the formation of the freeboard of the ship's hull, with this freeboard amounting to no less than 2.5% of the ship's length, as measured between the respective perpendiculars extending through the ship's rudder post and bow. This is noticeably distinct from the freeboard of conventional hatch cover containerships, which ranges between 0.8% to 1.5% of length. Any sea spray and rain that does enter the holds is readily evacuated by drain and pumping devices communicating with each hold.

1 Claim, 4 Drawing Sheets

OPEN CELLULAR CONTAINERSHIP

CROSS-REFERENCE TO RELATED APPLICATIONS

This is a continuation-in-part of my application Ser. No. 07/352,709, filed on May 11, 1989, now U.S. Pat. No. 5,090,353, issued Feb. 25, 1992 and which is a continuation of application Ser. No. 07/044,276, filed on Apr. 27, 1987, and now abandoned.

FIELD OF THE INVENTION

This invention relates generally to containerships and more particularly, to an improved containership construction allowing operation in a hatchcoverless environment.

BACKGROUND OF THE INVENTION

Since the advent of shipping vessels especially adapted to carry cargo as previously loaded into ISO containers, many improvements have been made in efforts to enhance or facilitate the loading and stowage of these container. For the most part, such efforts have been directed toward the development of lashing devices and guide systems to permit the loading of greater numbers of containers and with less labor requirements. The side walls of containership hulls as heretofore constructed provide a freeboard which has been designated by the International Load Line Convention 1986 to meet the requirements calculated to satisfy safe operation in prescribed sea lanes. These parameters are directed toward insuring seaworthy operation under all anticipated conditions with the required freeboard serving to accommodate fluctuations in green water conditions. Thus, shipping regulations with respect to the load water line and minimum statutory freeboard will be understood to vary, not only for sea lanes in different geographical zones but also, for winter and summer operations within each of these zones. Given any one sea lane, the minimum statutory freeboard may vary from 0.8% to 1.5% of a containership's length between perpendiculars. In calculating this length, the two perpendiculars will be understood to comprise lines respectively passing: 1) through the ships's rudder post center line and the summer toad waterline and (2) the line passing through the bow and the summer load waterline.

Conventional containership frequently are constructed with an increased freeboard, over the minimum statutory freeboard, allowing for the loading of one or more additional tier of containers between the strength decks of the hold side walls. In any case, with or without this increased freeboard, hatch covers are required to be provided atop the tier of containers disposed between the strength decks to maintain the necessary seaworthy conditions. The hatch covers themselves are of heavy, robust construction, necessary to withstand the substantial acceleration forces due to the ship's motion in a seaway and wave impact loading. Also, since several additional tiers of containers are usually carried atop the installed hatch covers, it follows that the construction of the hatch covers must be significant enough to withstand the noteworthy mass of these uppermost container tiers. Any containership construction which would allow omission of these hatch covers quite obviously results in several important advantages. First, the cost of the hatch covers is quite substantial. Next, one must appreciate that without the hatch covers, more space and weight allowance is made available for the containers and thus revenue-producing cargo. The above two advantages will also carry over, by the omission of the extra lashings which must be used when carrying containers atop hatch covers. Thirdly, and a most significant advantage, is the time and labor saved in loading and unloading a containership that avoids the necessity of having to use hatch covers over the respective holds. Thousands of dollars are saved during the loading or unloading of a hatchcoverless containership versus the same operation involving the current conventional containership equipped with hatch covers, Any improvement in containership construction which would enable the elimination of the present hatch covers would obviously provide an immense economical boon to the shipping industry.

DESCRIPTION OF THE RELATED ART

Examples of the existing practice in containerships will be found in U. S. Pat. Nos. 2,963,310 and 3,537,414 issued respectively, to Abolins on Dec. 6, 1960 and Goldman on Nov. 3, 1970. In each instance, vertical guides define cells within which pallets or containers are lowered and raised, as by an onboard or onshore traveling crane apparatus. Upon the loading of containers to a level adjacent the hull side wall strength deck, hatch covers are then lowered thereatop as depicted in FIG. 1 of Goldman, to seal the hold spaces against entry of green and blue water and to provide a platform for additional containers which may be carried on deck. None of the prior art of which I am aware suggests the construction of a seagoing containership specifically intended to obviate the need for hatch covers by presenting a freeboard of a minimum specified height, which freeboard is a factor of the ship's length and is significantly greater than that as specified by the International Load Line Convention 1986 for containerships having hatch covers. As an example, the Convention specifies that the minimum statutory freeboard for containerships having hatch covers and of a length of 200 meters, operating in sea lanes during one season of the year and in an area of the southern hemisphere, is 3.264 meters. This translates to a minimum statutory freeboard that is 1.632% of the ship's length.

SUMMARY OF THE INVENTION

By the present invention, an improved containership construction is advanced and wherein an increased freeboard, over and above the minimum statutory freeboard, is provided in a hatchcoverless vessel. The weatherseal as presented by hatch covers in conventional containerships has been found not to be required in a vessel's hull construction according to the instant invention wherein, the hull side walls are formed to provide a freeboard that is at least 2.5% of the containership's length between perpendiculars as measured at the summer load waterline. This is in stark contrast to the freeboard as practiced in conventional containerships employing hatch covers and wherein typically, the freeboard varies between 0.8% and 1.5% of the ship's length. Experience pursuant to this invention has proven the seaworthy nature of this unique hatchcoverless containership wherein, any green water as may be taken aboard over the strength decks during a stormy voyage, as well as blue water entering the spaces between stowed containers during tropical storms, is readily accommodated by conventional Dumps as provided in the various holds. Approval of the present design concept has been obtained from Lloyd's Register of Shipping, the Irish Department of the Marine and Australian Maritime Safety Authority and all of these authorities dictated the parameters of seakeeping tests during model tests in the Wuxi Seakeeping Basin in China. These tests confirmed that even under the most onerous circumstances, the ingress of sea water and spray into the open holds has been proven to be minimal and less than that to be expected from heavy rain. The instant design has received Lloyd's highest classification of +100A1. Following delivery of a ship according to the present concept, the novel containership has been through a force 9 and a force 10 gale in the English Channel during which the ship performed satisfactorily with no green water coming on board. Even should the ship experience the ultimate flooding condition, which can only be reached after a prolonged period of total loss of all power on board and while being subjected to heavy spray and rain, the ship remains afloat and stable as floodwater is eventually freed by means of hold discharge ports at the freeboard deck.

Accordingly, one of the objects of the present invention is to provide an improved cellular containership having its load bearing deck disposed well below the waterline under all conditions of loading.

Another object of the present invention is to provide an improved cellular containership having a hull formed with cargo holds for receiving tiers of containers and with all or the majority of this cargo stowage area operating without hatch covers.

A further object of the present invention is to provide an improved open cellular containership having a hull with sidewalls defining a freeboard above the load waterline which is no less than 2.5% of the ship's length.

An additional object of the present invention is to provide an improved hatchcoverless cellular containership including one or a plurality of open container cargo holds each having fore and aft pumping devices for removing rain and spray water entering the open top holds.

With these and other objects in view which will more readily appear as the nature of the invention is better understood, the invention consists in the novel construction, combination and assembly of parts hereinafter more fully described, illustrated and claimed with reference being made to the attached drawings.

BRIEF DESCRIPTION OF THE DRAWINGS

Similar reference characters designate corresponding parts throughout the several figures of the drawings.

DESCRIPTION OF THE PREFERRED EMBODIMENT

Figure 1:
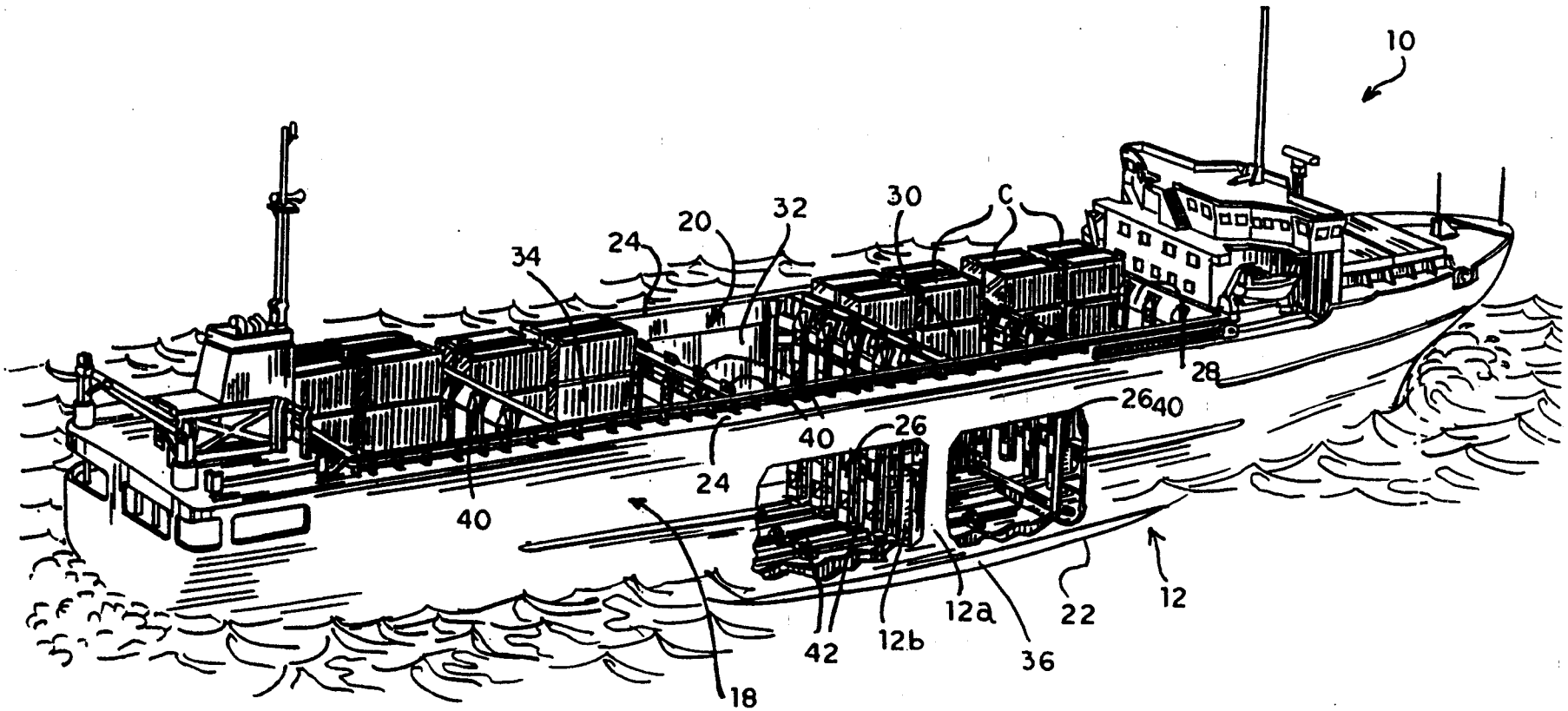
FIG. 1 is a top perspective view of a containership according to the present invention.
Figure 2:
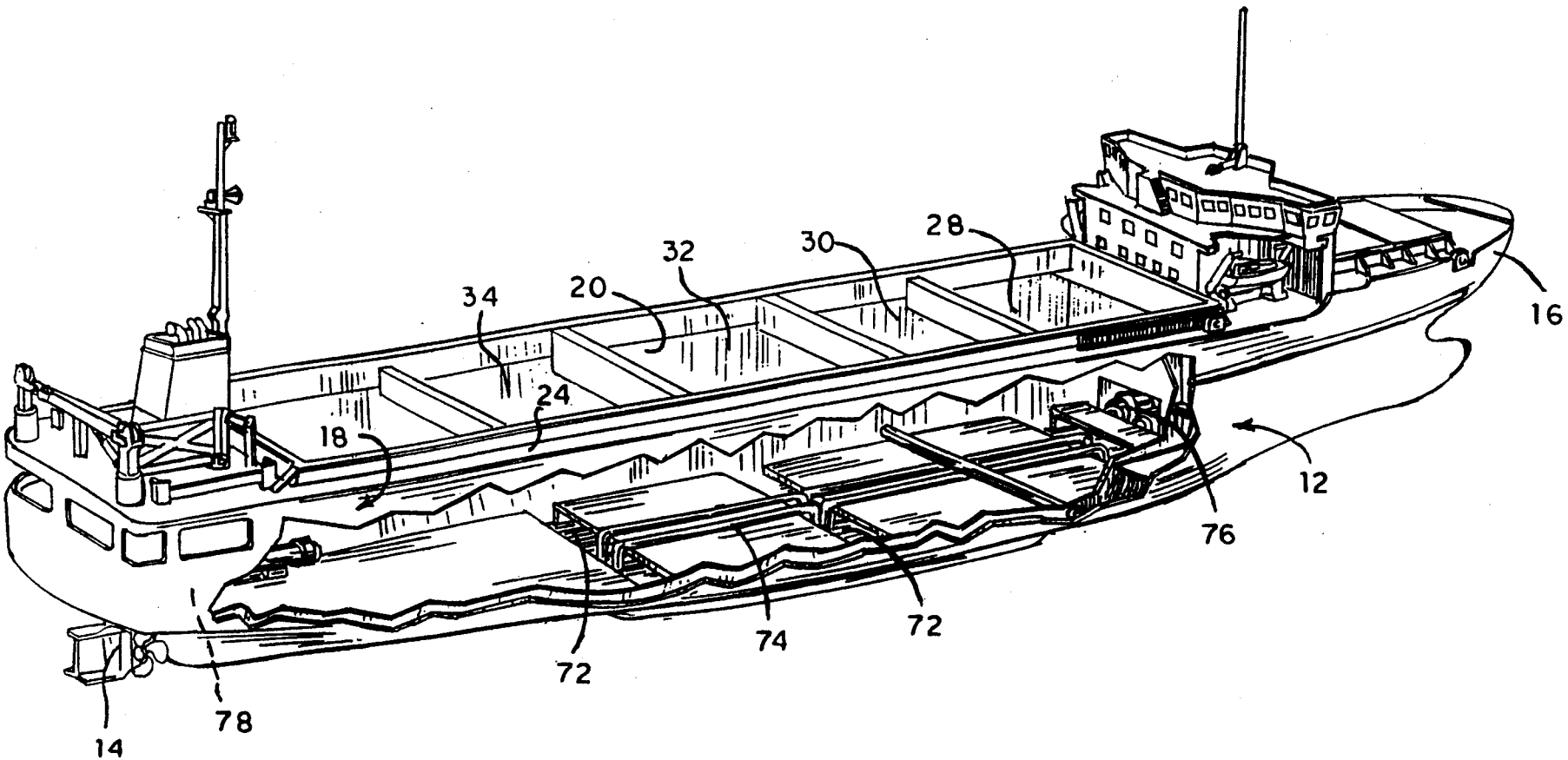
FIG. 2 is a view similar to FIG. 1 and with the bulkheads, containers, and cell guides removed to more clearly illustrate the drain wells and stripping pumps associated with the holds.
Figure 3:
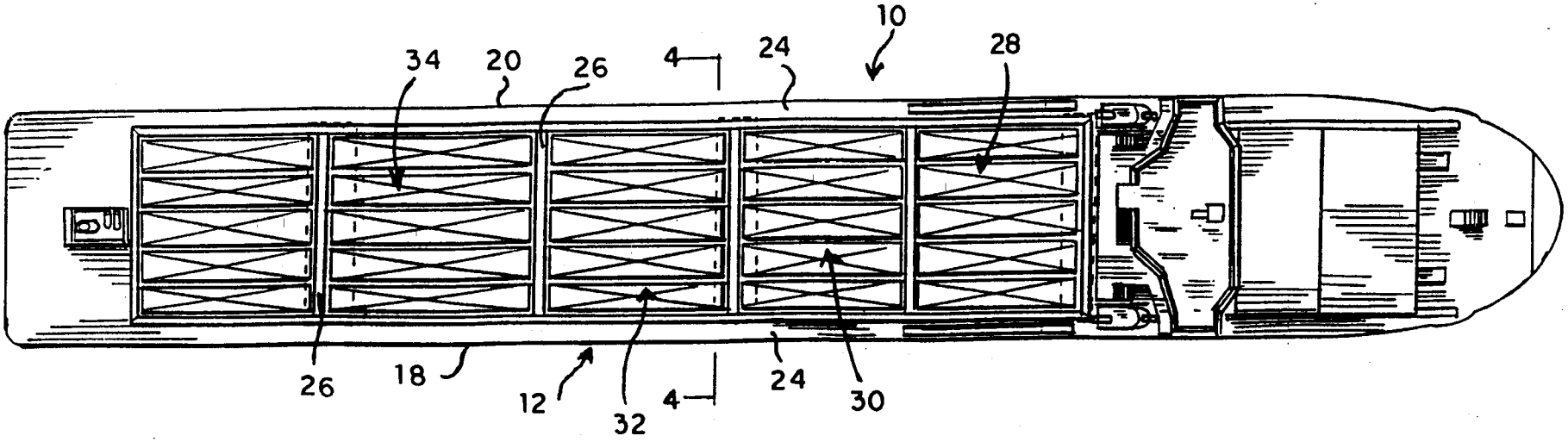
FIG. 3 is a top plan view of the containership.

Referring now to the drawings, particularly FIGS. 1 and 2, the present invention will be seen to comprise an improved hatch-coverless containership 10 including a hull 12 and defining a length which may substantially correspond to that of known conventional containerships having hatch covers. For example, the length may range from 50 meters to 300 meters, although the present concept is not restricted to this precise range. As is specified in the art, the length is defined as that distance between perpendiculars respectively passing through the ship's rudder post 14 and the bow 16.

The hull 12 is double-walled, that is, it comprises twin skins **12*a*–12*b* respectively forming opposite side walls 18, 20 joined to a bottom 22 and with the two side walls terminating with uppermost strength decks 24. The interior area within the hull 12 is divided into a plurality of container cargo carrying holds by transverse bulkheads 26 which may comprise skeletal bulkheads as shown in FIG. 1. Considering that an alternative may comprise an open type containership fitted with freeing ports, watertight bulkheads separating holds would not be required and accordingly, a single hold may be employed. The drawings illustrate a plurality of holds 28, 30, 32, 34 adjacent the midship 36 and which will be seen to extend to the load bearing deck 38 of the ship's bottom 22, which deck 38** will be understood to at all times be disposed below the waterline. Each of these holds are adapted to receive the maximum number of ISO (International Standards Organization) containers C which, by definition, comprise rectangular containers 20 feet in length by 8 feet wide and 8.5–9.5 feet in height.

It is known to load a containership with various combinations of 20 and 40 foot containers when filling the longitudinal extent of each hold, between its bulkheads. The containers C are lowered into the respective holds by well known traveling crane devices (not shown) located either dockside or, mounted atop the strength decks 24,24. The containers are stabilized within the holds by vertical guide members 40 adjacent each bulkhead 26, with four such guide members spaced apart to form a vertical cell adapted to receive a 40 foot or 20 foot containers C therebetween. The eight corners of ISO containers are provided with corner castings comprising formations adapted to receive either stool fittings 42 secured atop the load bearing deck 38 or, interlock fittings (not shown) employed to fixedly join the corner castings of two adjacent containers C.

Figure 5:
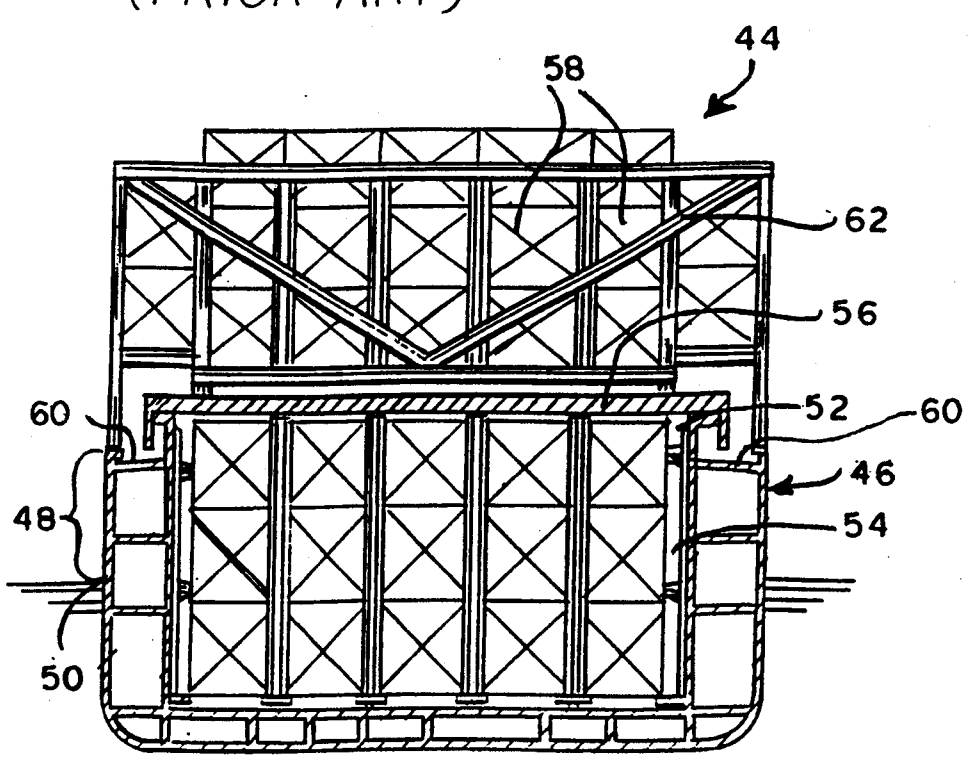
FIG. 5 (PRIOR ART)
FIG. 5 is a cross-sectional view of a conventional containership with hatch covers and lashings.
Figure 4:
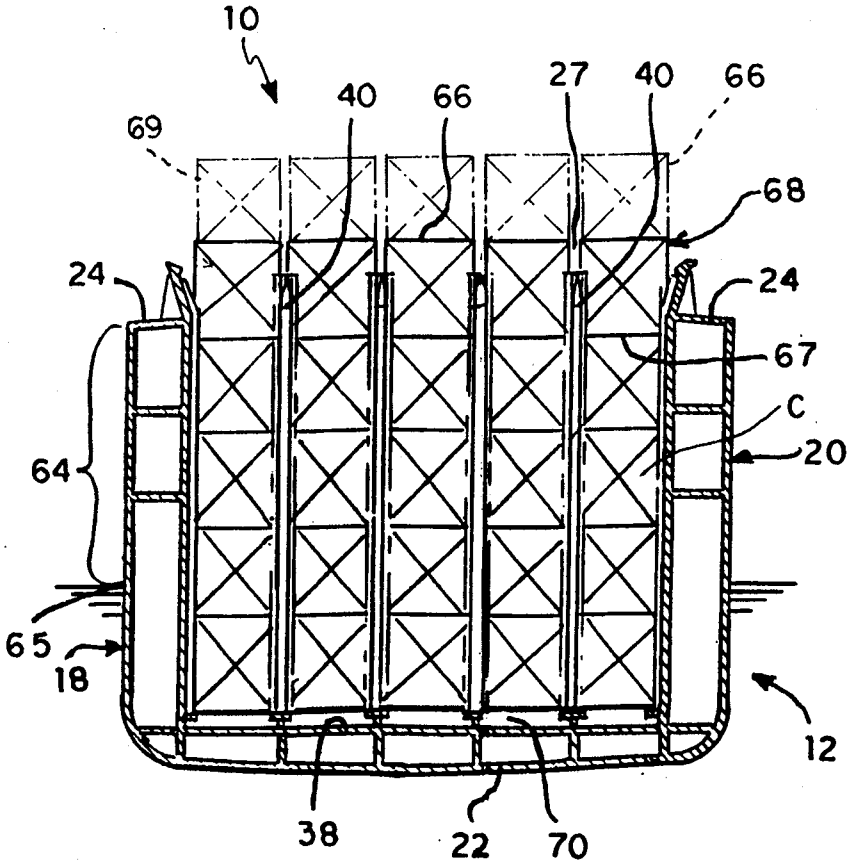
FIG. 4 is a cross-sectional view, taken along the line 4—4 of FIG. 3.

As the crux of the present invention is directed to the hatchcoverless feature presented by the containership 10, it will be appropriate at this point to appreciate the distinction between the instant ship and the conventional containership. A cross-section of the respective constructions is shown in FIGS. 4 and 5 with FIG. 4 depicting the unique construction advanced herein and FIG. 5 illustrating a typical conventional containership 44. The conventional containership hull 46 provides a freeboard 48 extending upwardly from the load waterline 50 an amount no less than the minimum statutory freeboard and which varies according to the ship's length. This specified minimum in turn is adjusted according to the geographical area of the sea-lanes to be traveled and, the season of the year. Typically, the minimum statutory freeboard varies from 0.8% to 1.5% of the ship's length and with this designated freeboard, requires the top opening 52 of the holds 54 to be enclosed by hatch covers 56 to preclude the entry of green and blue water. Additional containers 58 are usually loaded atop the hatch covers 56, above the level of the strength decks 60 and secured by lashing devices 62.

With the dramatically altered freeboard 64, above the load waterline 65 of the instant hull 12 as shown in FIG. 4, a full loading of containers C is accomplished and without the use of hatch covers atop the top surface 66 of the containers C forming the uppermost tier 68 as disposed at least partly within the hull. Five tiers are usually readily accomplished in at least one hold, with the bottom surface 67 of the top tier as located within or partly within the hull being disposed below the level of the strength decks 24,24. With any one containership 10, the load limits will accept a further tier 69 as shown in FIG. 4. An approved seaworthy ship 10 results from this construction and wherein the freeboard 64 will be understood to be no less than 2.5% of the ship's length, a vast departure from the above mentioned freeboard range specified for conventional containerships 44 requiring hatch covers 56.

Under stormy seas as well as during tropical storms, sea spray (green water) and rain (blue water) that passes through the open top 27 of the holds and between the stowed containers C, collects in the lower reaches 70 of the holds and is subsequently pumped overboard by a suitable system of known pumping devices. To facilitate the pickup of this collected water, large transverse drain wells 72 adjacent at least one end of each hold provide low areas to enhance the pickup of the water by bilge conduits 74 connected to fore and aft pump rooms 76, 78, either one of which is designed to individually handle the maximum amount of water anticipated to collect within the holds. Other well known pump arrangements as employed in containerships may obviously be utilized, such as pump pickups disposed at opposite corners of the holds, etc.

From the above, it will be appreciated that an improved containership is presented and wherein, by the significant extension of the freeboard, the need for hatch covers and coamings is precluded, It is to be understood that the present invention is not limited to the sole embodiment described above, but encompasses any and all embodiments within the scope of the following claims.

I claim:

1. A hatchcoverless sea-going containership including a hull having a bow, a rudder post located at an end opposite said bow, and a load waterline located in a horizontal plane transverse to said hull, said hull having a load bearing deck located below said load waterline bounded by opposite side walls, each presenting an uppermost strength deck, at least one hold between said side walls, spaced guide means within said hold defining a plurality of cells each adapted to house a plurality of stacked containers atop said load bearing deck, said hold presenting an open top devoid of hatch covers overlying any containers within said hold, with any containers above said strength decks being exposed to the elements, said containership having a length defined as the distance between perpendiculars passing through said bow and said rudder post and measured at the plane of said load waterline within the limit of said waterline, and said hull side walls defining a freeboard extending from said load waterline that is no less than 2.5% of said length of said containership, whereby said freeboard extending from said load waterline substantially limits entry of sea spray into said at least one hold even in rough seas and stormy weather, enabling said containership to travel on the open seas without hatch covers.

* * * * *